US011231041B2

(12) United States Patent
McGaugh

(10) Patent No.: US 11,231,041 B2
(45) Date of Patent: Jan. 25, 2022

(54) FAN LOCKING AND DISCONNECTION DEVICE AND RELATED SYSTEMS

(71) Applicant: Lankota Group, Inc., Huron, SD (US)

(72) Inventor: Daniel McGaugh, Huron, SD (US)

(73) Assignee: LANKOTA GROUP, INC., Huron, SD (US)

( * ) Notice: Subject to any disclaimer, the term of this patent is extended or adjusted under 35 U.S.C. 154(b) by 118 days.

(21) Appl. No.: 16/571,652

(22) Filed: Sep. 16, 2019

(65) Prior Publication Data

US 2020/0088206 A1 Mar. 19, 2020

Related U.S. Application Data

(60) Provisional application No. 62/731,216, filed on Sep. 14, 2018.

(51) Int. Cl.

| | |
|---|---|
| ***F04D 27/00*** | (2006.01) |
| ***F04D 19/00*** | (2006.01) |
| ***F04D 29/32*** | (2006.01) |
| ***E05B 17/22*** | (2006.01) |
| ***F04D 29/28*** | (2006.01) |
| ***F04D 17/16*** | (2006.01) |

(52) U.S. Cl.

CPC ..... *F04D 27/008* (2013.01); *E05B 17/22* (2013.01); *F04D 17/16* (2013.01); *F04D 19/002* (2013.01); *F04D 29/281* (2013.01); *F04D 29/325* (2013.01); *F05D 2240/30* (2013.01)

(58) Field of Classification Search

CPC ..... F04D 27/008

See application file for complete search history.

(56) References Cited

U.S. PATENT DOCUMENTS 2,467,797 A * 4/1949 Wise ..... H01H 71/523 337/44

9,188,130 B2 * 11/2015 Johnson ..... F04D 27/008

* cited by examiner

*Primary Examiner* — Juan G Flores

(74) *Attorney, Agent, or Firm* — Sean Solberg

(57) ABSTRACT

Various fan blade locking devices which operate to lock the blades of a fan in place and disconnect power to the fan. The locking device has an actuable bolt that, when in the locked position, extends to and contacts the fan blades and thereby stops the fan blades from turning. Additionally, the bolt has a contact washer coupled thereto such that the contact washer can engage with and disengage from a switch, thereby completing or interrupting a circuit supplying power to the fan, which allows for the locking device to prevent the fan from being actuated while the bolt is in contact with the fan blades.

16 Claims, 10 Drawing Sheets

FAN LOCKING AND DISCONNECTION DEVICE AND RELATED SYSTEMS

CROSS REFERENCE TO RELATED APPLICATION

This application claims the benefit under 35 U.S.C. § 119(e) to U.S. Provisional Application 62/731,216, filed Sep. 14, 2018 and entitled "Fan Locking and Disconnection Device and Related Systems," which is hereby incorporated by reference in its entirety.

FIELD OF THE INVENTION

The various embodiments herein relate to fans, especially fans for use in grain bins, and further to devices for locking such fans to prevent the blades from rotating as a result of wind when the fan is not in use.

BACKGROUND OF THE INVENTION

Centrifugal fans, such as the exemplary centrifugal fan 2 depicted in FIG. 1, are often utilized in agriculture to dry and aerate harvested crops such as corn. One disadvantage of these centrifugal fans are that they may be nearly constantly turning even while off, due to slight winds or other factors. This near constant turning can cause the fan to break or need maintenance prematurely due to overuse. The near constant turning can potentially cause worn out start switches and/or a need to replace bearings, capacitors, and motors.

Prior attempts to solve the problem of constant blade rotation include placing a block of wood in the fan to prevent the fan from turning. However, this block of wood can be forgotten and the fan turned on while the block of wood is still in place, likely destroying the fan and creating a safety hazard for anyone in the vicinity of the fan.

Another known solution to the problem of constant blade rotation is the use of a fan cover. Fan covers are placed over the opening of the fan while it is not in operation to block wind from entering the fan, thereby preventing the wind from causing the blades to turn. However, fan covers have many disadvantages, including that they can be eaten by mice and/or they may harden and crack in the sun. As a result, fan covers typically must be replaced frequently.

There is a need in the art for a device or system to safely and easily stop the blades of a centrifugal fan from rotating when the fan is not in operation.

BRIEF SUMMARY OF THE INVENTION

Discussed herein are various devices and systems for locking fan blades and disconnecting power to the fan.

In Example 1, a fan locking and disconnection device comprises a device housing coupleable to an external surface of a fan, a switch disposed within the device housing, a bolt slidably disposed within the device housing, an actuation handle operably coupled to the bolt, and an electrical cable electrically coupled at a first end to the switch, wherein the electrical cable is configured to be electrically coupleable at a second end to a fan control box. The bolt comprises a contact washer attached to the bolt, an engaged position wherein the bolt is frictionally engaged with a fan blade and the contact washer is not in contact with the switch, and a disengaged position wherein the contact washer is in contact with the switch. The actuation handle comprises a locked position wherein the bolt is in the engaged position, and an unlocked position wherein the bolt is in the disengaged position.

Example 2 relates to the device of Example 1, wherein the fan is a centrifugal fan.

Example 3 relates to the device of Example 1, wherein the device housing is coupleable to the external surface of the fan via a backing plate and mounting hardware.

Example 4 relates to the device of Example 1, wherein the electrical cable is coupled at one end to the switch and at the other end to the magnetic starter coil.

Example 5 relates to the device of Example 1, wherein, when the actuation handle is in the locked position, the power to the fan is disconnected.

Example 6 relates to the device of Example 1, wherein, when the actuation handle is in the locked position, the fan is prevented from turning.

Example 7 relates to the device of Example 1, further comprising a grain bin operably coupled with the fan.

In Example 8, a fan locking system comprises a fan, an elongate bolt, and a handle operably coupled with the bolt, wherein the handle is constructed and arranged to urge the bolt between the engaged and disengaged positions. The elongate bolt comprises an engaged position wherein the bolt is in frictional contact with the fan, and a disengaged position wherein the bolt is retracted from the fan.

Example 9 relates to the system of Example 8, further comprising a switch, an electrical cable operably coupled with the switch, wherein the electrical cable and the switch are part of an electrical start circuit for the fan, and a contact washer disposed along the bolt, wherein, when the bolt is in the disengaged position, the contact washer is in operative contact with the switch, and wherein, when the bolt is in the engaged position, the contact washer is not in contact with the switch.

Example 10 relates to the system of Example 9, wherein the electrical cable is operably coupled with a magnetic starter coil.

Example 11 relates to the system of Example 10, wherein the fan cannot be actuated when the bolt is in the engaged position.

Example 12 relates to the system of Example 11, wherein the fan is a centrifugal fan.

In Example 13, a method of controlling the blades of a fan comprises coupling a fan locking device to a side of the fan, wherein the fan locking device comprises an elongate bolt, and a handle operably coupled with the bolt. The method further comprises urging the handle into an engaged position wherein the bolt is in frictional contact with the fan, and urging the handle into a disengaged position wherein the bolt is retracted from the fan.

Example 14 relates to the method of Example 13, wherein the urging the handle into the engaged position causes power to the fan to be disconnected.

Example 15 relates to the method of Example 13, wherein the urging of the handle into the disengaged position causes power to the fan to be connected.

Example 16 relates to the method of Example 13, wherein the fan locking device further comprises a switch, an electrical cable operably coupled with the switch, wherein the electrical cable and the switch are part of an electrical start circuit for the fan, and a contact washer disposed along the bolt.

Example 17 relates to the method of Example 16, wherein the urging the handle into the engaged position causes the contact washer to not be in contact with the switch, whereby the electrical start circuit is open such that the power to the fan is disconnected.

Example 18 relates to the method of Example 16, wherein the urging the handle into the disengaged position causes the contact washer to be in contact with the switch, whereby the electrical start circuit is closed such that the power to the fan is connected.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

The various embodiments disclosed herein relate to a locking device, such as a blade locking device, that is attached to a fan housing. Such a locking device can be used to stop/prevent fan blades from turning while the fan is not on. Additionally, the locking device may also have a feature that disconnects power to the fan while the device is in the engaged/locked/ON position.

Figure 1:
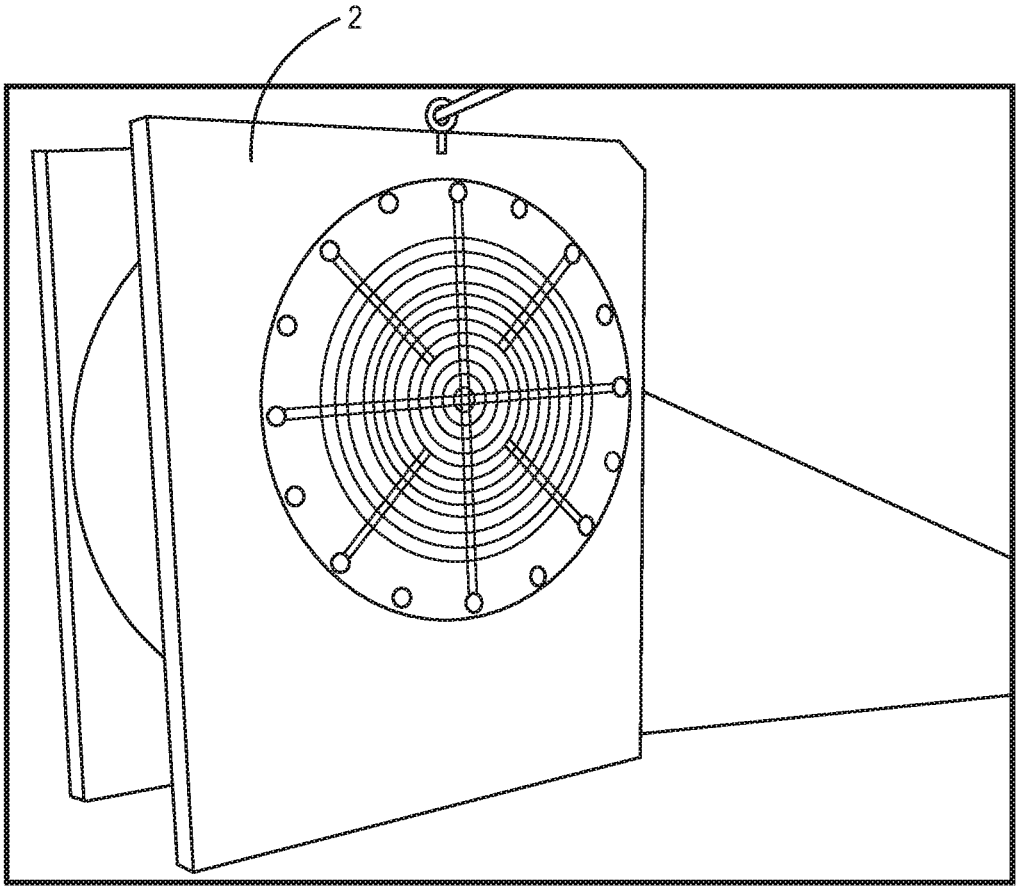
FIG. 1 (Prior Art)
FIG. 1 is a side view of a known centrifugal fan.

It is understood that the various locking device embodiments disclosed or contemplated herein can be incorporated into various types of fans, including, for example, a centrifugal fan similar to the fan 2 depicted in FIG. 1. It is further understood that the various locking device embodiments can be coupled to and operable with any number of known fans, including any other known types of grain bin fans and any other known fans used in outdoor environments.

Figure 2A:
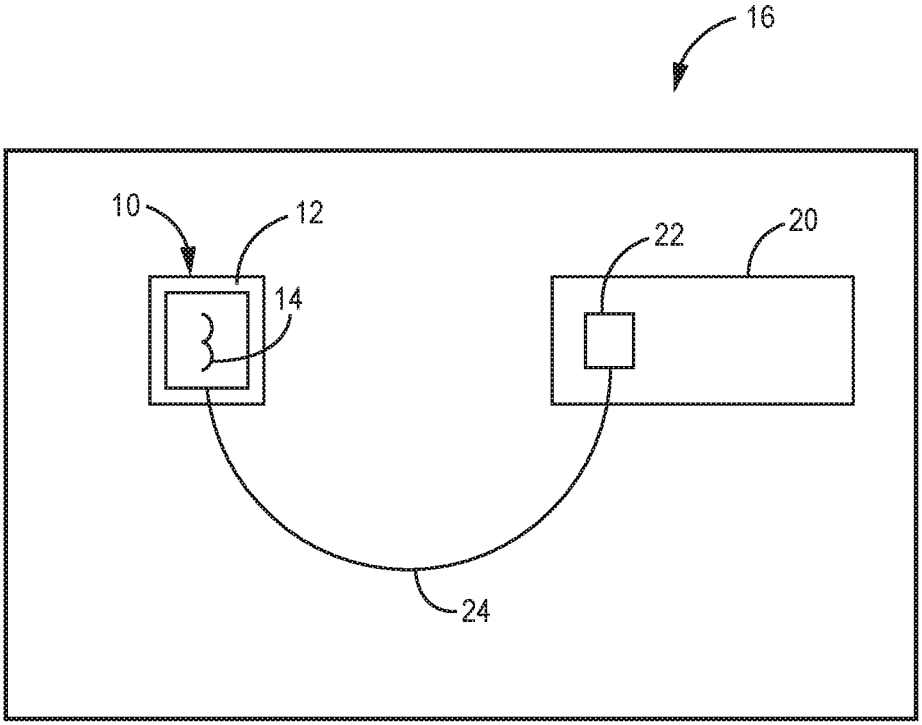
FIG. 2A is a front schematic view of a fan with a fan locking device, according to one embodiment.
Figure 2B:
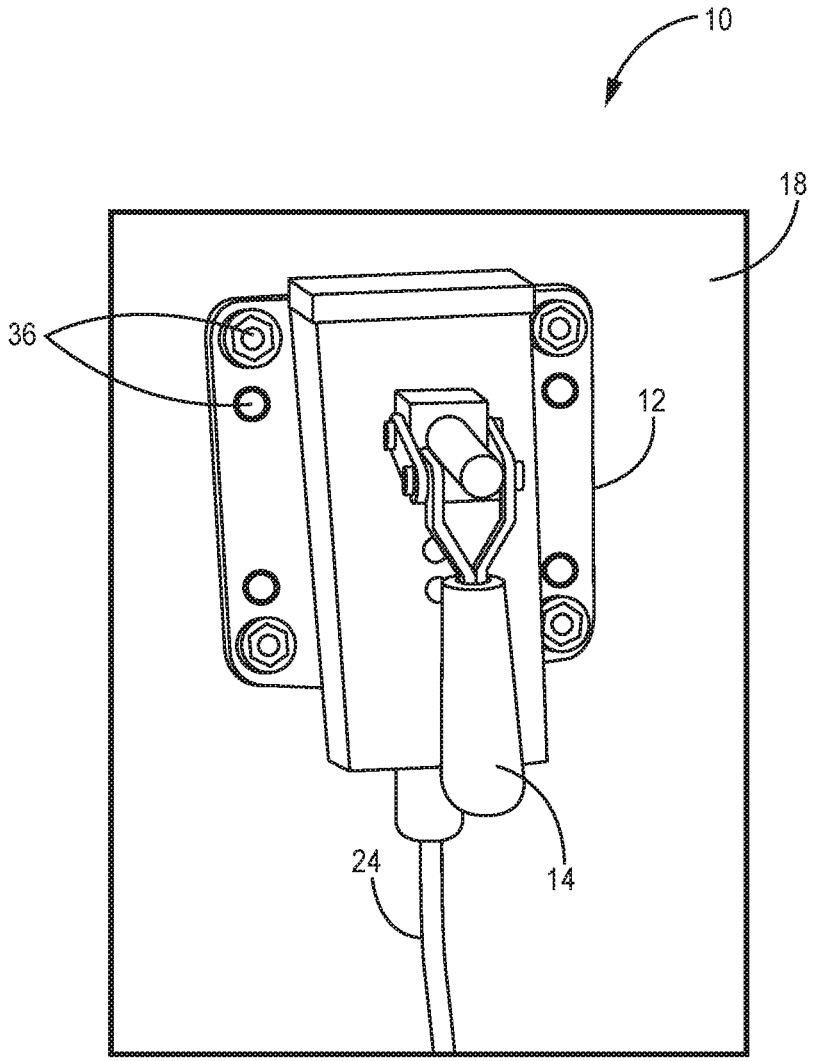
FIG. 2B is a front view of the fan locking device of FIG. 2A, according to one embodiment.
Figure 3:
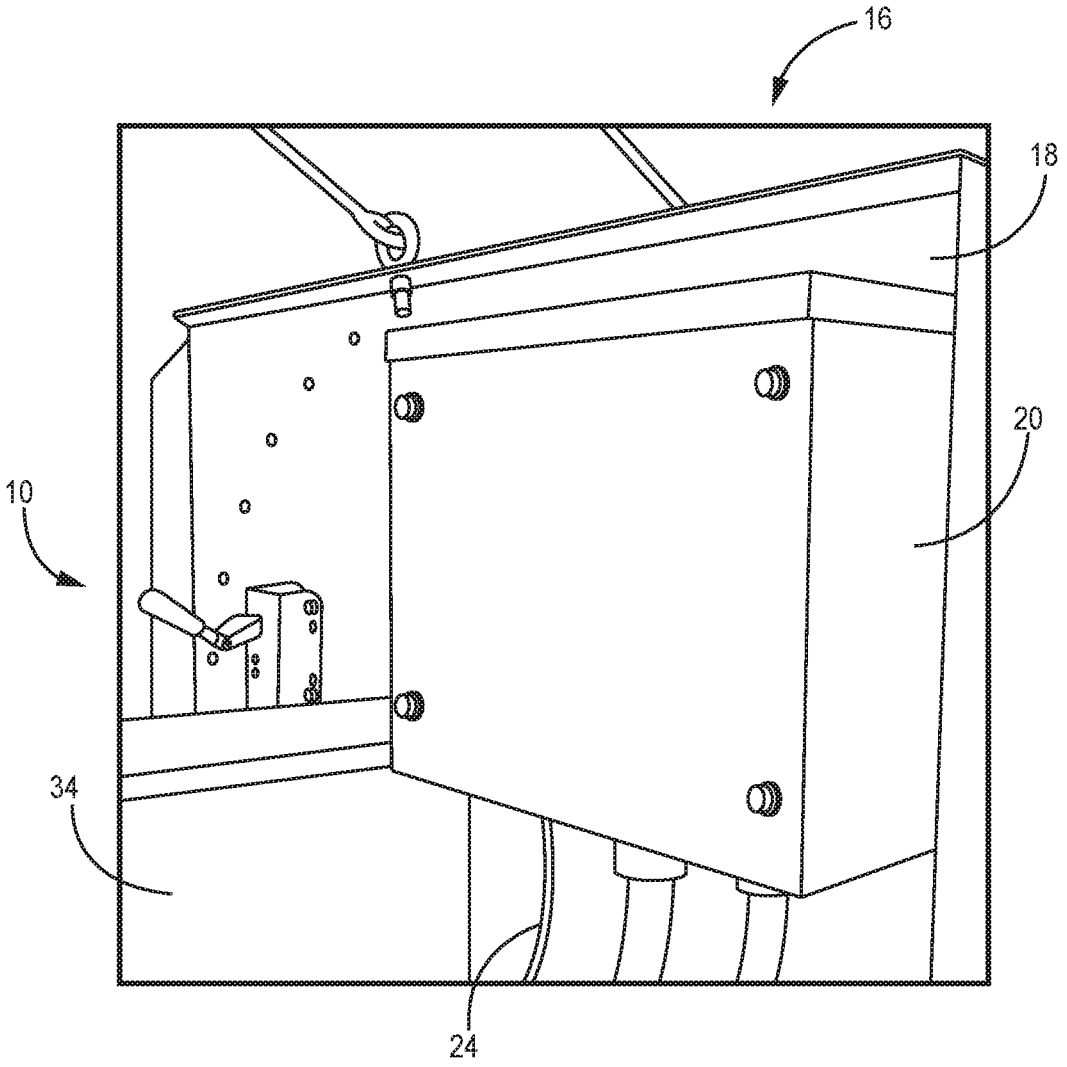
FIG. 3 is a perspective view of a fan housing with a fan locking device disposed thereon, according to one embodiment.

Referring to FIGS. 2A, 2B, and 3, according to one embodiment, the locking device 10 is coupled to or otherwise integrated into a fan, such as, for example, fan 16. More specifically, in certain embodiments, the locking device 10 has a housing or enclosure 12 that can be attached to the housing 18 of the fan 16 such that the locking device 10 can be used to lock the fan blades (such as blades 54, for example) in place, as discussed in detail below. In one implementation as best shown in FIG. 2A, the device 10 is coupled to the electrical control box 20 of the fan 16 via the electrical cable 24, which extends between the device enclosure 12 and the electrical box 20. More specifically, the cable 24 can be coupled to the starter coil 22 that is positioned within the control box 20. In some implementations as shown in FIG. 3, the electrical cable 24 will pass below the fan motor 34. Further, in certain embodiments as best depicted in FIGS. 2A and 2B, the electrical cable 24 exits the bottom of the device enclosure 12, while other variations are possible. As best shown in FIG. 2B, the device 10 has an actuation handle 14 pivotally coupled to the housing 12 such that a user can engage or disengage the device 10, as will be described in additional detail below. In FIG. 2B, the handle 14 is disposed downward in the disengaged or "off" position. A user can urge the handle 14 upward to move it into the engaged or "on" position. The disengaged and engaged positions will be discussed in further detail below.

FIGS. 4-7 provide various depictions of the internal components of the locking device 10. As best shown in FIG. 5A (depicting a rear exploded view of the device 10) and 5B (depicting a front exploded view of the device 10), the device 10 has an actuation handle 14 (mentioned above), a plunger bolt 32 coupled to the handle 14 (such that actuation of the handle 14 causes the bolt 32 to extend into the engaged position or retract into the disengaged position, respectively, as will be described in further detail below), and an electrical switch 30. The electrical switch 30, according to one embodiment, is part of a safety feature incorporated into the locking device 10. That is, the electrical switch 30 is electrically coupled to the control box 20 of the fan 16 (to which the device 10 is attached) via the electrical cable 24 and is configured to interact with the plunger bolt 32 such that extension of the plunger bolt 32 into the engaged position causes the switch 30 to cut off power to the fan 16 at the control box 20, thereby preventing a user from turning on the fan 16 while the locking device 10 is in the engaged (or "locked") position. More specifically, when the actuation handle 14 is urged into the engaged position, the plunger bolt 32 extends into its engaged position, which triggers the switch 30 to cut power to the fan 16 via the electrical cable 24. This safety feature is described in additional detail below.

In one embodiment, the electrical switch 30 is a microswitch 30 (and will generally be referred to as such for the remainder of the application). Alternatively, the switch 30 can be any known switch or sensor for detecting the presence or absence of the plunger bolt 32 in a fashion similar to that discussed herein.

According to certain implementations, the bolt 32 is a plunger bolt 32 (and will generally be referred to as such for the remainder of the application). Alternatively, the bolt 32 can be any elongate, rod- or bolt-like structure (and can be referred to herein as a "contact bolt" or "contact rod") 32 having two ends. One end (a first end or proximal end) is coupled to the actuation handle 14 and the other end (a second end or distal end) is disposed such that it can contact or engage with some portion of the fan while in the engaged (or "locked" or "on") position, thereby creating sufficient contact friction between the distal end and the fan such that the fan blades cannot rotate. One specific embodiment of the interaction between the bolt 32 and a fan is described in further detail below.

Figure 4:
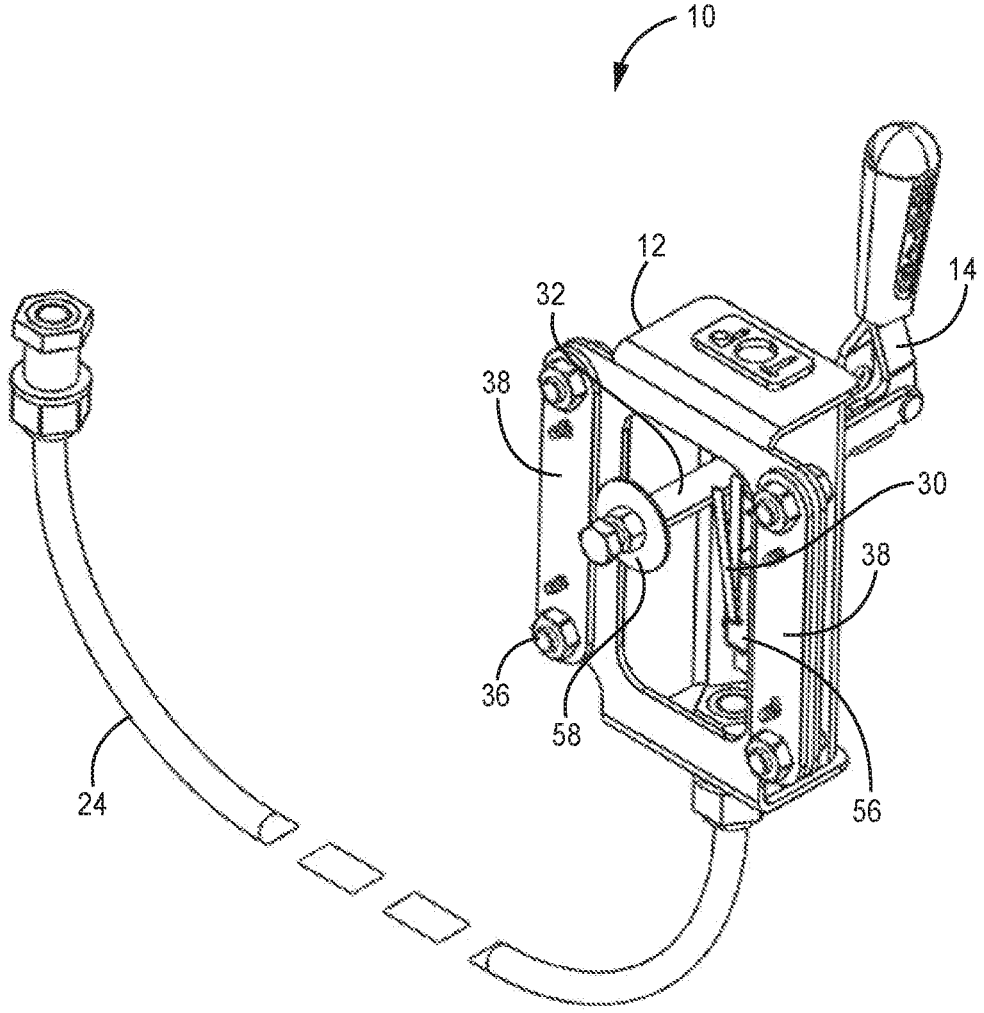
FIG. 4 is a rear view of a fan locking device, according to one embodiment.
Figure 5A:
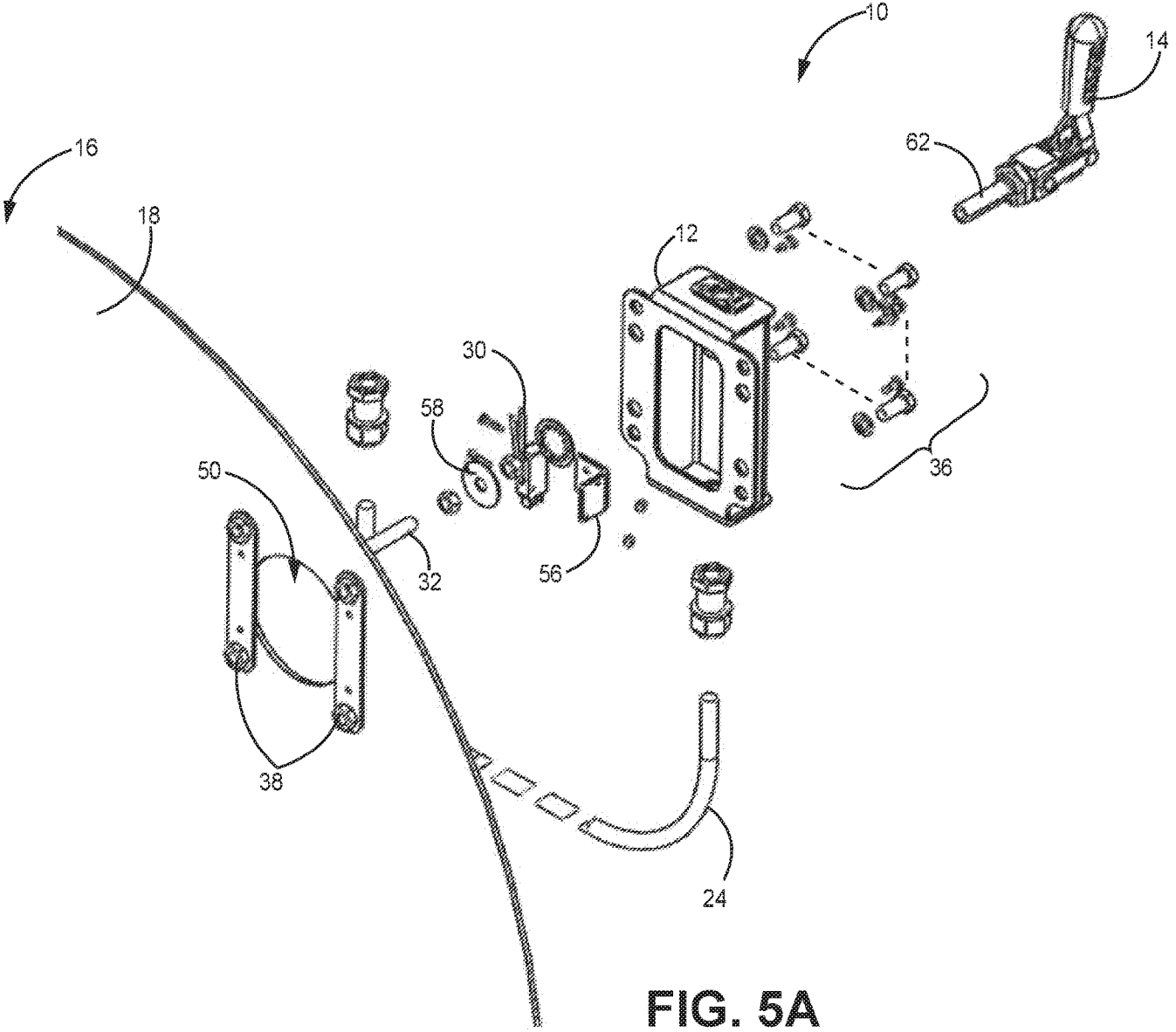
FIG. 5A is an exploded rear view of the fan locking device, according to one embodiment.

FIG. 4 depicts an rear view of the locking device 10 (the side of the device 10 that is coupled to the fan housing 18), according to one embodiment. In this specific implementation, the device enclosure 12 can be attached to the fan housing 18 via a backing plate 38, which can be attached to an inner surface of the fan housing 18, as is depicted in FIG. 5A and discussed in further detail below. Further, the housing 12 can have mounting hardware 36 that can attach the device housing 12 to the backing plate 38 through the fan housing 18, thereby attaching the device 10 to the fan 16. It is understood that the mounting hardware 36 may include bolts, screws, washers, and/or any other attachment mechanisms known to those of skill in the art. Alternatively, it is understood that the device housing 12 can be attached to the fan housing 18 via any known mechanisms or methods.

Figure 6:
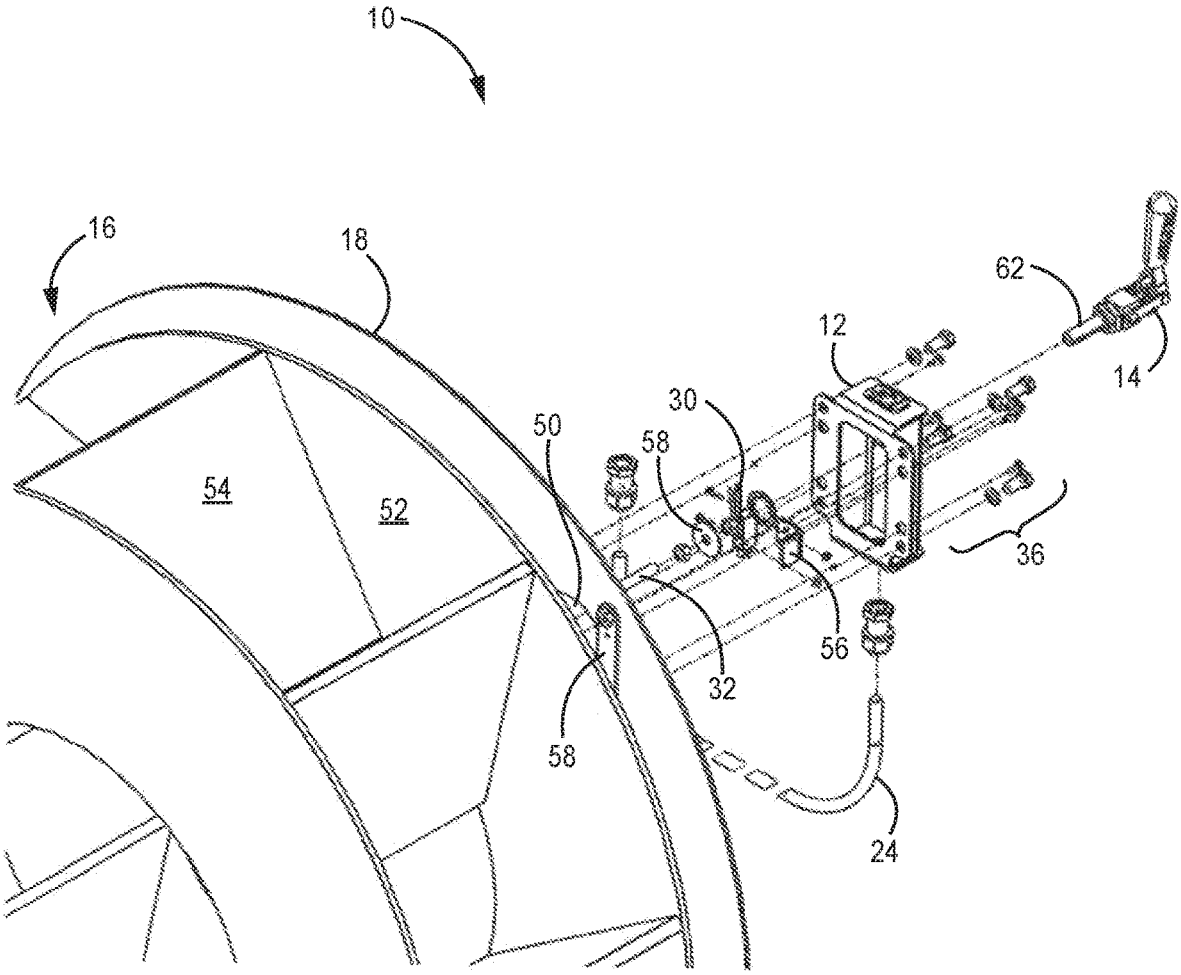
FIG. 6 is an exploded rear view of the fan locking device disposed for attachment to a fan, according to one embodiment.

FIG. 5A depicts an exploded rear view of the device 10 in position for attachment to a fan housing 18. Similarly, FIG. 6 depicts an exploded rear view of the device 10 in position for attachment to the fan housing 18 with the fan blades 54 depicted as well. An opening 50 formed in the wall of the fan housing 18 allows access to the fan blade plate 52 (as best shown in FIG. 6) such that the plunger bolt 32 can pass through the fan housing 18 via the opening 50 to the fan blade plate 52 when the device housing 12 is coupled to the fan housing 18 via the backing plate 38 as discussed above. Alternatively, instead of the backing plate 38, any other known attachment mechanism or component can be used, as would be recognized by those of skill in the art. In the specific implementation disclosed herein, the bolt 32 is coupled to the elongate member 62 as will be discussed in further detail below. Alternatively, the plunger bolt 32 can be coupled directly to the actuation handle 14 or via any other component or mechanism. In the engaged or locked position, the distal end of the plunger bolt 32 is physically in contact with the plate 52 with sufficient force to create frictional contact that prevents the fan blades 54 from rotating. By stopping the fan blades 54 from turning, the device 10 works to prevent premature wear and tear upon the fan 16 and associated equipment increasing the life of the fan 16 and its parts. The plunger bolt 32 is coupled to the actuation handle 14 such that operation of the actuation handle 14 by a user between the "on" and "off" positions causes the plunger bolt 32 to move between an engaged position (in which the plunger bolt 32 is engaged with the fan blade plate 52) and a retracted position (also referred to herein as the "disengaged" or "off" position), as will be discussed in further detail below.

Figure 5B:
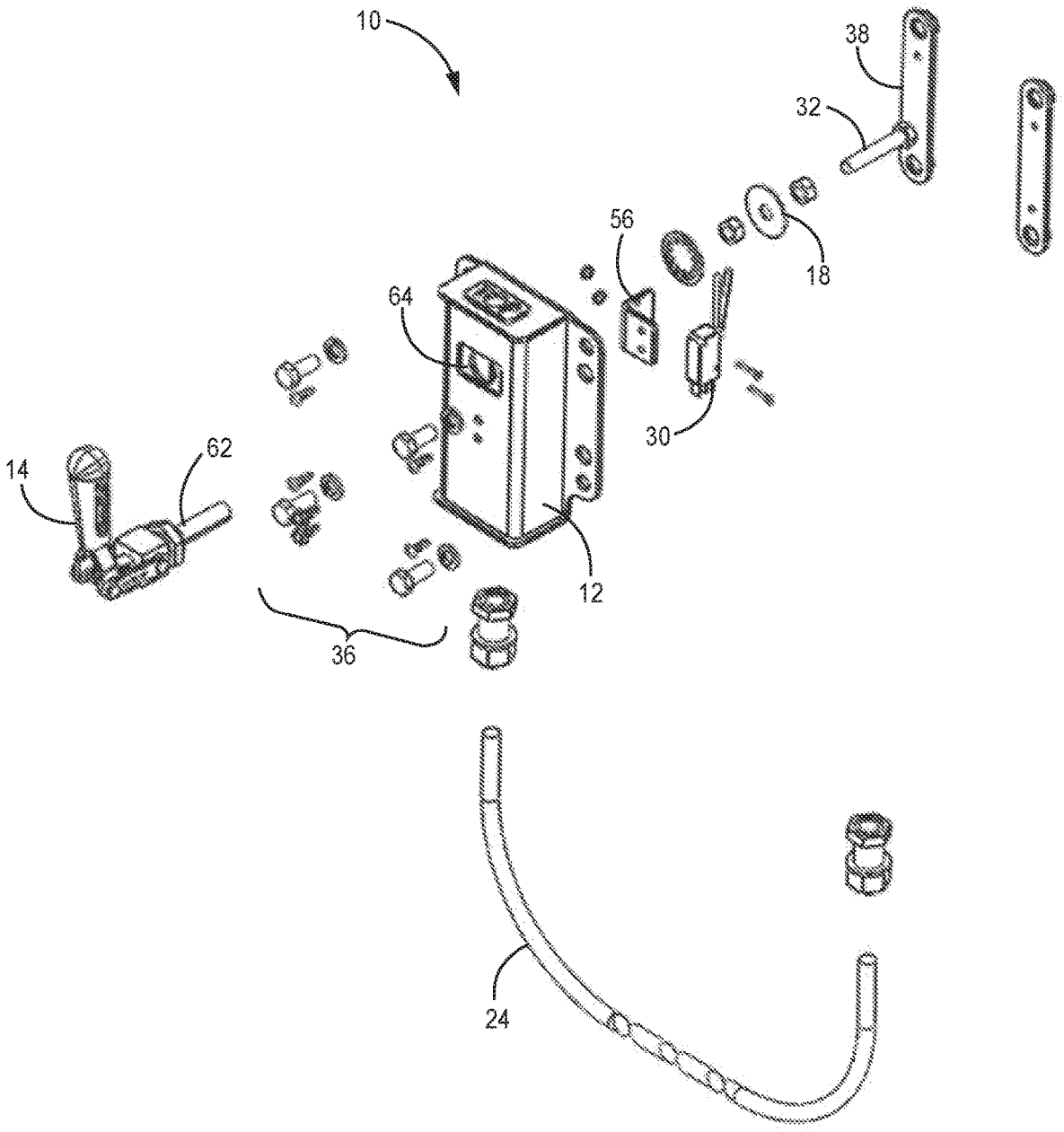
FIG. 5B is an exploded front view of the fan locking device, according to one embodiment.

FIG. 5B, as mentioned above, shows an exploded view of the device 10 from a front angle, according to one embodiment. The actuation handle 14 (and more specifically the elongate member 62 attached thereto) passes through an opening 64 in the device housing 12. As discussed above, the actuation handle 14 is engaged with one end of the plunger bolt 32. According to one embodiment, the actuation handle 14 has an elongate member 62 extending distally from the handle 14 with a female connection at the end of the elongate member 62 such that a threaded proximal end of the plunger bolt 32 can be inserted into and thereby threadably attached to the elongate member 62. Alternatively, any known coupling mechanism or feature can be used, or the plunger bolt 32 can be coupled directly to the actuation handle 14.

Referring to FIGS. 2A and 5A-6, safety feature (the fan power disconnection feature) of the locking device 10 mentioned above will now be described in further detail. In accordance with one embodiment as best shown in FIG. 2A, the device 10 is electrically coupled to the magnetic starter coil 22 in the fan control box 20 via the electrical cable 24, which extends from the microswitch 30 within the locking device 10 to the control box 20. In one implementation, the microswitch 30 (shown in FIGS. 5A-6) is mounted on the device enclosure 12 via a mounting plate 56 or other attachment mechanism known to those of skill in the art. The microswitch 30 interacts with the plunger bolt 32 via a contact washer 58, which is disposed on and attached to the plunger bolt 32 (as best shown in FIGS. 4-6. More specifically, the movement of the plunger bolt 32 causes the contact washer 58 to move into and out of electrical contact with the microswitch 30. When the plunger bolt 32 is in the engaged position, the washer 58 is not in contact with the microswitch 30, thereby triggering the microswitch to cut off power to the fan 16. When the plunger bolt 32 is in the disengaged position, the washer 58 is in electrical contact with the microswitch 30, thereby completing the electrical circuit and allowing power to flow to the fan 16.

That is, in one embodiment as best shown in FIG. 4, the contact washer 58 is positioned and attached at a predetermined location along the length of the plunger bolt 32 such that when the actuation handle 14 is in the locked or ON position, the contact washer 58 is not in contact with the microswitch 30 (and thus the power to the magnetic starter coil 22 is cut off, because the electrical circuit is not complete), and when the device is in the unlocked/OFF position, the contact washer 58 is in contact with the microswitch 30, thereby completing the circuit and allowing power to the fan 16.

Figure 8:
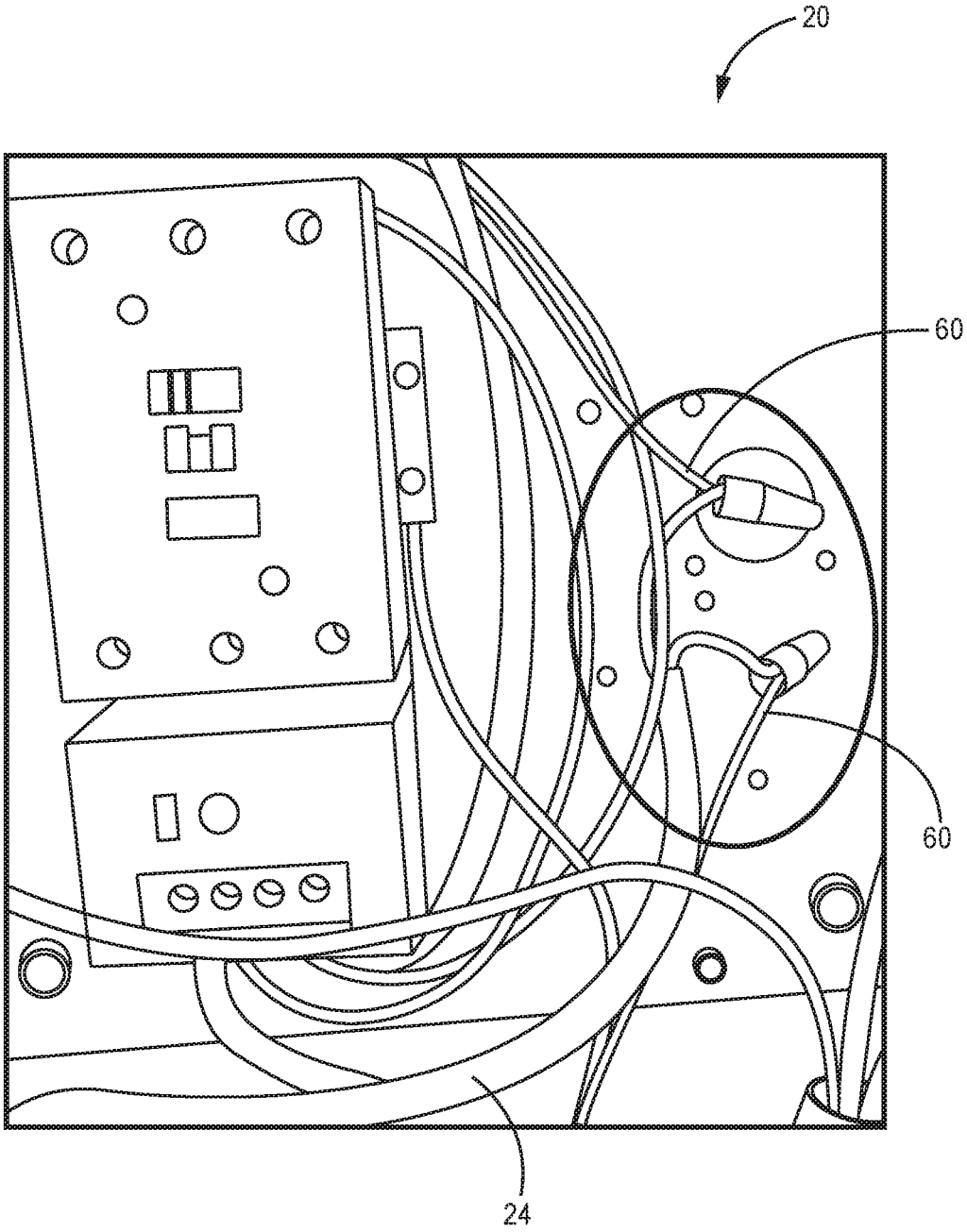
FIG. 8 is a front view of an electrical box interior, according to one embodiment.

As discussed above, the electrical cable 24 in accordance with one embodiment is coupled at one end to the microswitch 30 and at the other end to the magnetic starter coil 22 as discussed in further detail below. In one implementation, the electrical cable 24 has at least two wires. The electrical cable 24 connects the microswitch 30 to a wire 60 that feeds power to the magnetic starter coil 22 on the fan 16 (see FIG. 8). The electrical cable 24 is spliced into the wire 60 for the magnetic starter coil 22, thereby creating a circuit that can be broken when the contact washer 58 is not engaged with the microswitch 30, as discussed above. Alternatively, the electrical cable 24 can be electrically coupled to any component of the control box 20 or other part of the fan 16 or associated systems that, when disconnected, would safely prevent the fan 16 from being turned on.

Thus, when the actuation handle 14 is in the "off" or disengaged position (as best shown in FIG. 2B), the plunger bolt 32 is in the retracted or disengaged position such that the contact washer 58 is engaged with the microswitch 30, thereby completing the circuit and thus allowing power to the magnetic starter coil 22 for the fan 16. On the other hand, when the actuation handle 14 is in the "on" or engaged position (as best shown in FIGS. 4-7), the plunger bolt 32 is in the extended or engaged position such that the contact washer 58 is not in contact with the microswitch 30, and thus the microswitch 30 is disengaged from the contact washer 58. When the microswitch 30 is disengaged, the circuit is broken and power is disconnected from the magnetic starter coil 22 for the fan 16. When power is disconnected from the magnetic starter coil 22 for the fan 16, the fan 16 cannot be turned on, thereby ensuring that no user can turn on the fan 16 while the locking device 10 is in the engaged position.

Figure 7:
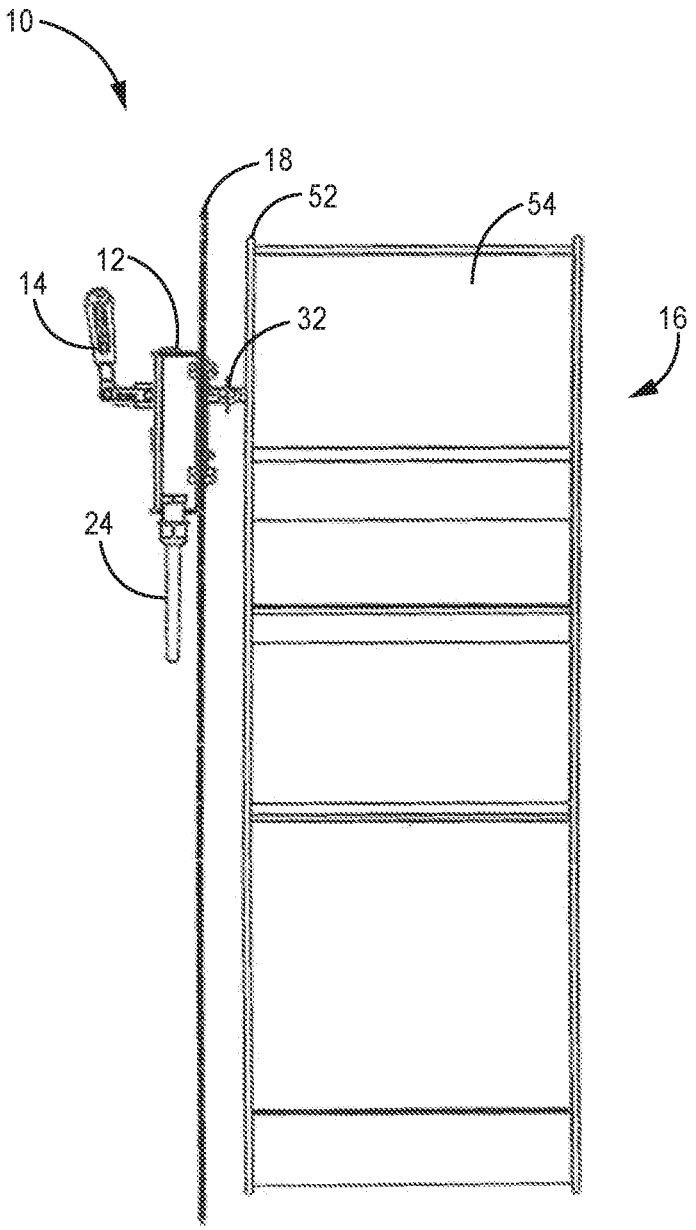
FIG. 7 is a cross-sectional side view of the fan locking device attached to a fan, according to one embodiment.

FIG. 7 depicts a cross-sectional side view of the locking device 10 attached to a fan housing 18, according to one embodiment. As discussed above, the actuation handle 14 can be urged into two positions by a user: either (1) the locked/ON position (as best shown in FIGS. 4-7) wherein the plunger bolt 32 is in contact with the fan blade plate 52 such that the blades 54 cannot turn and the power to the magnetic starter coil 22 is disconnected as a result of the contact washer 58 not being in contact with the microswitch 30, or (2) the unlocked/OFF position (as best shown in FIG. 2B) in which the plunger bolt 32 is not in contact with the fan blade plate 52 such that the blades 54 can freely turn and power to the magnetic starter coil 22 is connected as a result of the contact washer 58 being in contact with the microswitch 30, thereby allowing the fan 16 to be turned on.

As mentioned above, FIG. 8 depicts the connection of the electrical cable 24 (which is coupled to the microswitch 30 as discussed above) to the wire 60 feeding power to the magnetic starter coil 22, according to one embodiment. The wire 60 may be spliced to allow for the two wires contained within the electrical cable 24 to be attached to the wire 60, thereby creating a circuit including the device 10, and more specifically the microswitch 30. It is understood that the wire 60 may be the wire 60 to the magnetic starter coil or any other wire that when interrupted would safely prevent the fan 16 from being turned on.

Although the present invention has been described with reference to preferred embodiments, persons skilled in the art will recognize that changes may be made in form and detail without departing from the spirit and scope of the invention.

What is claimed is:

1. A fan locking and disconnection device, the device comprising:

(a) a device housing coupleable to an external surface of a fan;

(b) a switch disposed within the device housing;

(c) a bolt slidably disposed within the device housing, the bolt comprising:

(i) a contact washer attached to the bolt;

(ii) an engaged position wherein the bolt is frictionally engaged with a fan blade and the contact washer is not in contact with the switch; and (iii) a disengaged position wherein the contact washer is in contact with the switch;

(d) an actuation handle operably coupled to the bolt, wherein the actuation handle comprises:

(i) a locked position wherein the bolt is in the engaged position; and (ii) an unlocked position wherein the bolt is in the disengaged position; and (e) an electrical cable electrically coupled at a first end to the switch, wherein the electrical cable is configured to be electrically coupleable at a second end to a fan control box.

2. The device of claim 1 wherein the fan is a centrifugal fan.

3. The device of claim 1 wherein the device housing is coupleable to the external surface of the fan via a backing plate.

4. The device of claim 1 wherein the electrical cable is coupled at the second end to a magnetic starter coil associated with the fan control box.

5. The device of claim 1 wherein, when the actuation handle is in the locked position, power to the fan is disconnected.

6. The device of claim 1 wherein, when the actuation handle is in the locked position, the fan is prevented from turning.

7. The device of claim 1 further comprising a grain bin operably coupled with the fan.

8. A fan locking system, comprising:

(a) a fan;

(b) an elongate bolt comprising:

(i) an engaged position wherein the bolt is in frictional contact with the fan; and (ii) a disengaged position wherein the bolt is retracted from the fan;

(c) a handle operably coupled with the bolt, wherein the handle is constructed and arranged to urge the bolt between the engaged and disengaged positions;

(d) a switch;

(e) an electrical cable operably coupled with the switch, wherein the electrical cable and the switch are part of an electrical start circuit for the fan; and (f) a contact washer disposed along the bolt, wherein, when the bolt is in the disengaged position, the contact washer is in operative contact with the switch, and wherein, when the bolt is in the engaged position, the contact washer is not in contact with the switch.

9. The system of claim 8, wherein the electrical cable is operably coupled with a magnetic starter coil.

10. The system of claim 9, wherein the fan cannot be actuated when the bolt is in the engaged position.

11. The system of claim 10, wherein the fan is a centrifugal fan.

12. A method of controlling blades of a fan, the method comprising:

coupling a fan locking device to a side of the fan, the fan locking device comprising:

(a) an elongate bolt;

(b) a handle operably coupled with the bolt;

(c) a switch;

(d) an electrical cable operably coupled with the switch, wherein the electrical cable and the switch are part of an electrical start circuit for the fan; and (e) a contact washer disposed along the bolt;

urging the handle into an engaged position wherein the bolt is in frictional contact with the fan; and urging the handle into a disengaged position wherein the bolt is retracted from the fan.

13. The method of claim 12, wherein the urging the handle into the engaged position causes power to the fan to be disconnected.

14. The method of claim 12, wherein the urging of the handle into the disengaged position causes power to the fan to be connected.

15. The method of claim 12, wherein the urging the handle into the engaged position causes the contact washer to not be in contact with the switch, whereby the electrical start circuit is open such that power to the fan is disconnected.

16. The method of claim 12, wherein the urging the handle into the disengaged position causes the contact washer to be in contact with the switch, whereby the electrical start circuit is closed such that power to the fan is connected.

* * * * *